United States Patent [19]

Rigberg et al.

[11] Patent Number: 4,897,826

[45] Date of Patent: Jan. 30, 1990

[54] NOVELTY WRIST WATCH

[76] Inventors: Allan Rigberg, 300 E. 75th St. (12B), New York, N.Y. 10021; Jeff Lewis, 25 Guyer Rd., Westport, Conn. 06880

[21] Appl. No.: 802,325

[22] Filed: Nov. 27, 1985

[51] Int. Cl.[4] ..... G04B 37/00

[52] U.S. Cl. ..... 368/282; 368/281; 368/223; D10/32; D10/34; D10/35

[58] Field of Search ..... 368/45, 281, 282; D10/1, 2, 6–8, 30–32, 33–35, 38, 39; D11/3, 6

[56] References Cited

U.S. PATENT DOCUMENTS

| | | | |
|---|---|---|---|
| 3,672,157 | 6/1972 | Manceri | 368/282 |
| 4,178,751 | 12/1979 | Liautaud | 368/281 |
| 4,307,459 | 12/1981 | Iwao | 368/45 |
| 4,462,697 | 7/1984 | Thompson | 368/282 |

FOREIGN PATENT DOCUMENTS

| | | | |
|---|---|---|---|
| 248252 | 4/1947 | Switzerland | 368/281 |
| 335174 | 12/1958 | Switzerland | 368/282 |
| 343946 | 2/1960 | Switzerland | 368/281 |
| 346177 | 6/1960 | Switzerland | 368/282 |

*Primary Examiner*—Bernard Roskoski
*Attorney, Agent, or Firm*—Michael Ebert

[57] ABSTRACT

A novelty wrist watch which when worn displays both a timepiece and an elongated figure or character in an arrangement in which the timepiece and one section of the character overlie the top surface of the wrist, and the remaining sections of the character lie against at least one edge of the wrist and over the bottom surface thereof, whereby the character appears to embrace the wrist. The wrist watch is formed from a single piece of flexible plastic material having a flat underface to engage the wrist, the piece being molded so as to form a main body constituted by the elongated character and a case integral therewith to accommodate the timepiece movement and its dial, and two auxiliary members, one integral with and extending from one end of the body to define a first strap, and the other integral with and extending from the opposite end of the body to define a second strap terminating in a buckle to receive and catch the first strap to form a band encircling the wrist.

3 Claims, 2 Drawing Sheets

Fig. 5.
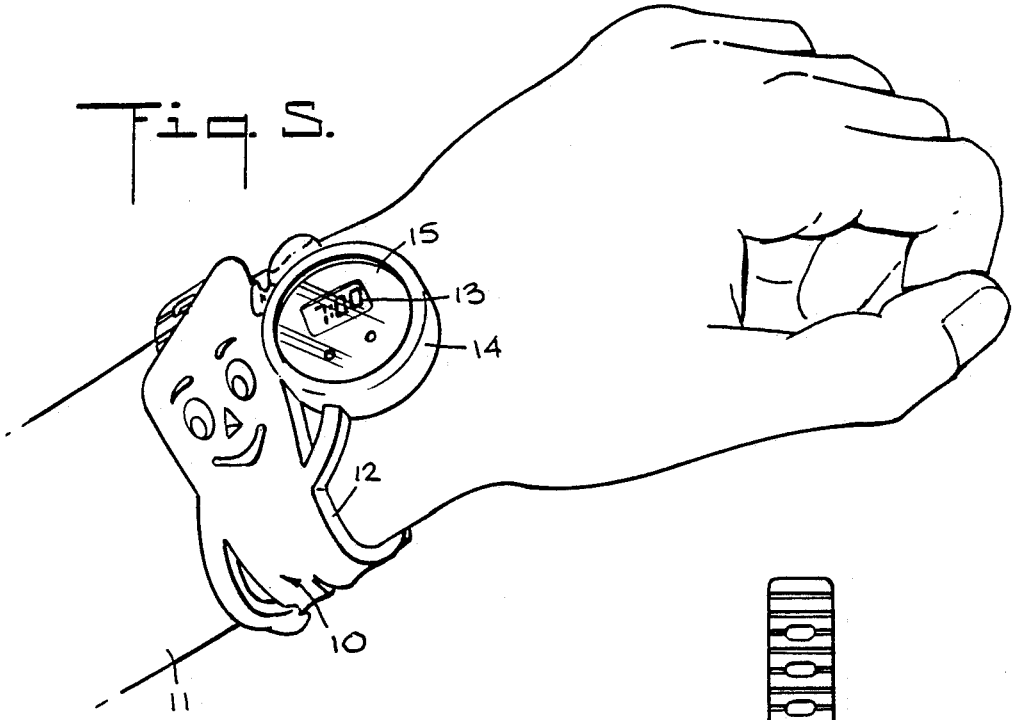
Fig. 6.
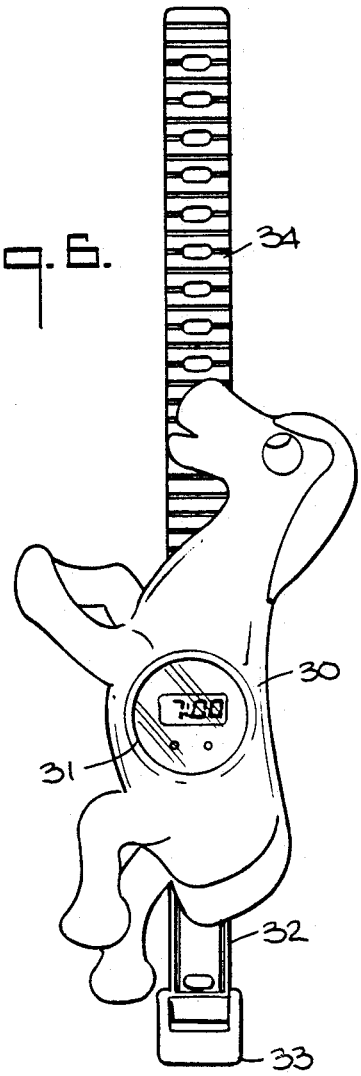
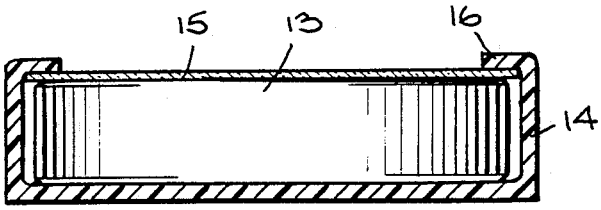
Fig. 4.

NOVELTY WRIST WATCH

BACKGROUND OF INVENTION

1. Field of Invention:

This invention relates generally to wrist watches, and in particular to a wrist watch having a case for accommodating a timepiece movement and its dial, a decorative character which incorporates the case, and auxiliary members forming the straps of the wrist band, all of which are integrated in a single molded piece of flexible plastic material.

2. Status of Art:

The traditional wrist watch, whether of the electronic or mechanical type and having an analog or digital readout, includes a metal case for housing the movement and its dial. Also provided is a separable wrist band formed by two flexible straps which may be fabricated of metal, plastic or fabric material. One strap which has a slidable loop thereon and terminates in a buckle is attached to one end of the case. The other strap which is attached to the opposite end of the case is receivable by the buckle on the first strap, the tail of the second strap being held in the loop on the first strap, so that the band formed by the cooperating straps encircles the wrist.

The typical novelty watch has essentially the same structure as a traditional watch, the novelty usually residing in the nature of the dial and the hands which turn on the dial. Thus, in the classic "Mickey Mouse" novelty watch, printed on the dial is a two-dimensional colored representation of the familiar "Mickey Mouse" cartoon character, the hands of the watch being contoured to resemble the hands of this character.

In other known forms of novelty or decorative watches, the case is fancifully shaped, but the band remains conventional. When, therefore, a novelty watch of the type heretofore known is worn on the wrist, whatever novelty exists is limited is limited to the upper face of the wrist, the watch otherwise lacking novelty. And since the novelty region is relatively small and inconspicuous, it attracts little attention.

The underlying purpose of a novelty watch is to decorate the wrist, its appeal residing in the visual impression made on those who see the watch. Thus when one wears a decorative bracelet having diamonds thereon, its attraction lies in its impact on an observer who sees the glittering bracelet and whose position relative to the wearer may be such that his view is not toward the top face of the bracelet, but more toward the edges thereof. However, in the typical novelty watch, its novelty may escape the observer when the timepiece is not in his line of sight; for if he sees mainly the conventional band, this makes no significant impression.

To give another analogy, one popular form of bracelet is in the shape of a snake that appears to encircle the wrist of the wearer regardless of how the bracelet is seen by an observer. But in the case of a novelty wrist watch in which a snake appears on the dial of the watch, no similar impression would be made.

SUMMARY OF INVENTION

In view of the foregoing, the main object of this invention is to provide a novelty watch in which the novelty resides in a character or figure which appears to embrace the wrist of the wearer so as to disguise or play down the time-keeping function of the watch, and make it appear that the wearer's wrist is embraced by a fanciful and attractive character.

More particularly, an object of this invention is to provide a novelty watch of the above type in which the character has hands, and in which the timepiece appears to be held up by one of these hands, so as to create an apparent relationship between the character and the timepiece.

Also an object of the invention is to provide a wrist watch formed by a single piece of molded flexible plastic material which is shaped so as to define not only the character but also the case for the timepiece and its dial, as well as the cooperating straps forming the wrist band.

Still another object of the invention is to provide a one-piece novelty wrist watch which may be manufactured at relatively low cost.

Briefly stated, these objects are attained in a novelty wrist watch which when worn displays both a timepiece and an elongated figure or character in an arrangement in which the timepiece and one section of the character overlie the top surface of the wrist, and the remaining sections of the character lie against at least one edge of the wrist and over the bottom surface thereof, whereby the character appears to embrace the wrist. The wrist watch is formed from a single piece of flexible plastic material having a flat underface to engage the wrist, the piece being molded so as to form a main body constituted by the elongated character and a case integral therewith to accommodate the timepiece movement and its dial, and two auxiliary members, one integral with and extending from one end of the body to define a first strap, and the other integral with and extending from the opposite end of the body to define a second strap terminating in a buckle to receive and catch the first strap to form a band encircling the wrist.

OUTLINE OF DRAWINGS

For a better understanding of the invention as well as other objects and further features thereof, reference is made to the following detailed description to be read in conjunction with the accompanying drawings, wherein:

FIG. 4 is a section taken in the plane indicated by line 404 in FIG. 3;

FIG. 5 shows the watch when on the wrist of the wearer; and

FIG. 6 is a top view of another embodiment of a wrist watch in accordance with the invention.

DESCRIPTION OF INVENTION

First Embodiment

Referring first to FIG. 5, there is shown a novelty watch in accordance with the invention, generally designated by numeral 10, as it appears when strapped onto the wrist 11 of a wearer. The watch includes an elongated character 12 which in the form illustrated is the well-known character "GUMBY." This figure appears to encircle the wrist as it holds in one of its hands a digital watch 13.

Figure 2:
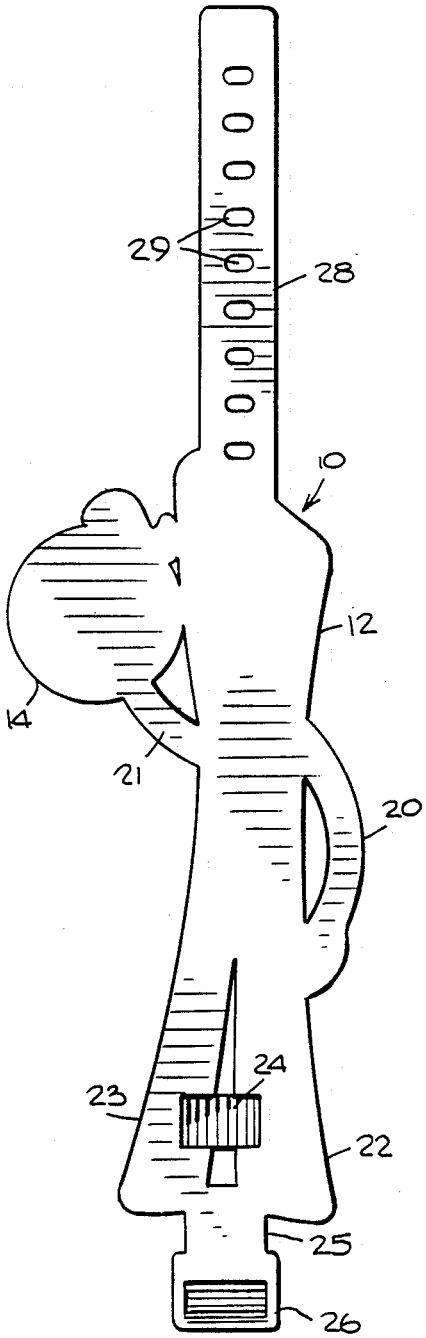
FIG. 2 is a bottom view of the wrist watch.

The entire wrist watch is created from a single piece of flexible plastic material such as polyvinyl chloride or polyethylene whose underface, as shown in FIG. 2, is flat and smooth to comfortably engage the surface of the wrist. This plastic piece is so molded as to form a main body which, in addition to the elongated character 12, incorporates a circular case 14. As shown separately in FIG. 4, case 14 is adapted to accommodate the digital watch 13 which is provided with a circular dial 15 having a rectangular window to expose the digital readout. The movement in this instance is entirely electronic and includes a miniature battery.

Case 14 in which the timepiece movement is nested includes a circular rim 16 which overlies the periphery of the movement and the dial to lock them in the case. Rim 16, being of flexible plastic material, is easily pulled back to admit the movement in the case, the rim then resuming its normal position.

Figure 1:
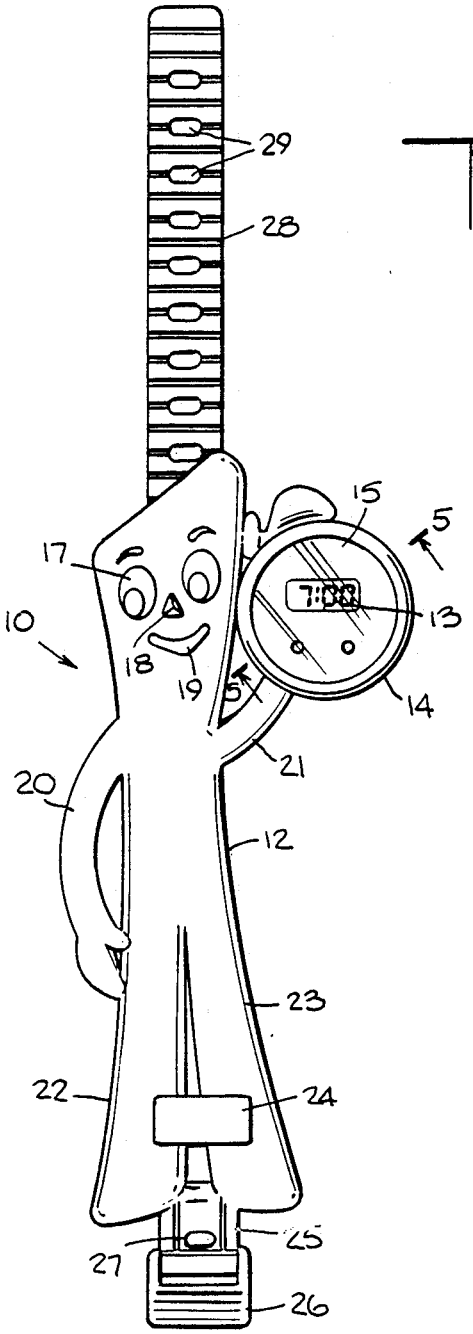
FIG. 1 is a top view of one embodiment of a novelty wrist watch in accordance with the invention.
Figure 3:
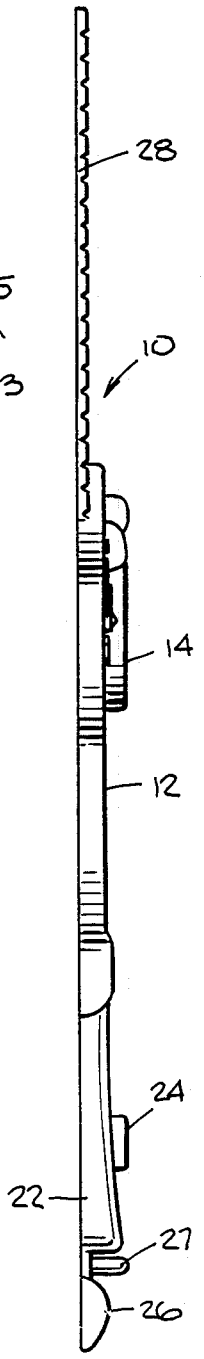
FIG. 3 is a side view of the wrist watch.

Character 12, as best seen in FIG. 1, has an upper section provided with a pair of eyes 17, a nose 18 and a mouth 19 molded therein to simulate a humanoid head whose shape is somewhat trapezoidal. The intermediate section of the character has two arms, the left arm 20 being held down and terminating in a hand touching a leg, the right arm 21 being held up and merging with case 14 of the timepiece, so that this case appears to be gripped by the hand of this arm. Thus, the impression made by this arrangement is that the character is holding up the timepiece to view. The lower section of the character is defined by a pair of outwardly flared legs 22 and 23 which are bridged near the feet by a hoop 24.

The single plastic piece further includes two auxiliary members, one extending from the lower end of the main body to define a short strap 25 terminating in a buckle 26 having a catch pin 27 thereabove. The other member extends from the upper end of the main body to define a long strap 28 having a row of holes 29 therein which cooperate with catch pin 27. When mounted on the wrist of a wearer, the long strap 28 is received in buckle 26 of the short strap, the tail of the long strap being held in hoop 24, and with catch pin 27 going into the hole 29 adjacent thereto to prevent withdrawal of the long strap.

Thus, when the wrist watch is strapped on the wrist, the upper or head section of the character as well as the timepiece overlie the top surface of the wrist to render the timepiece readable. The intermediate section then lies against one edge of the wrist and the lower section of the character overlies the bottom surface of the wrist. As a consequence, the character, rather than being confined to the top surface of the wrist, is wrapped about the wrist, thereby giving the impression that the character is embracing the wrist.

The character and the watch case which form the main body of the wrist watch and the auxiliary members which define the straps are all integrated into a single molded plastic piece, the only element separable therefrom being the replaceable watch movement.

From a decorative standpoint, the wrist watch is dominated by the elongated character and the timepiece is incidental thereto; hence, while the wrist watch is useful in that it gives the time, it is primarily a decorative or novelty bracelet.

Second Embodiment

The invention is not limited to any one character configuration as long as whatever character is embodied in the one-piece plastic is elongated so that it wraps about the wrist.

Thus, in the character illustrated in FIG. 6, character 30 in this instance is a horse-like figure having forelegs and rear legs, with the timepiece case 31 which is integral with the character being placed on the body between the forelegs and rear legs.

In this embodiment, the short strap 32 which terminates in buckle 33 extends from the rear of the character and the long strap 34 from the front of the character. When, therefore, this character is strapped onto the wrist, the intermediate section of the horse and the timepiece lie on top of the wrist, with the upper section and the lower section curling about the edges of the wrist and continuing to the underside, again giving the impression of a figure wrapped about the wrist.

While there have been shown and described preferred embodiments of a novelty wrist watch in accordance with the invention, it will be appreciated that many changes and modifications may be made therein without, however, departing from the essential spirit thereof.

I claim:

1. A novelty wrist watch formed from a single piece of flexible plastic material having a flat undersurface to engage the wrist of a wearer, said single piece comprising:

A. a main body constituted by an elongated character and a case integral therewith and displaced therefrom to accommodate a timepiece movement, the length of the elongated character exceeding the width of the wrist of the wearer, said character including an arm which terminates in a hand that merges with the case, whereby the character appears to be holding the timepiece; and B. two auxiliary members integral with the main body, one extending from one end of the character to define a first strap, the other extending from the opposite end of the character to define a second strap terminating in a buckle to receive the first strap, whereby when the wrist watch is strapped to the wrist, the character appears to be wrapped thereabout and gives the impression that the wearer's wrist is embraced by the character, said character including a pair of legs from which the second strap extends, said legs being bridged by a hoop to hold the tail of the first strap which is received by the buckle.

2. A wrist watch as set forth in claim 1, wherein said first strap is provided with a series of holes and the second strap is provided with an integral catch pin to engage a selected hole.

3. A wrist watch as set forth in claim 1, wherein said case is provided with an inwardly-directed flexible rim to trap the movement therein.

* * * * *